United States Patent [19]

Atimichuk

[11] 4,402,096

[45] Sep. 6, 1983

[54] FOLDING BED CHAIR WITH DETACHABLE CUSHIONS

[75] Inventor: Stan W. Atimichuk, Toronto, Canada

[73] Assignee: Morgan Green, Bradford, Canada; a part interest

[21] Appl. No.: 272,655

[22] Filed: Jun. 11, 1981

Related U.S. Application Data

[63] Continuation-in-part of Ser. No. 163,321, Jun. 26, 1980.

[51] Int. Cl.[3] ..... A47C 13/00

[52] U.S. Cl. ..... 5/17; 5/37 C

[58] Field of Search ..... 5/17, 18 R, 37 R, 37 B, 5/37 C, 41, 43, 44 R, 44 B

[56] References Cited

U.S. PATENT DOCUMENTS

| | | | |
|---|---|---|---|
| 687,320 | 11/1901 | Kuersten | 5/37 R |
| 696,671 | 4/1902 | Gay | 5/37 R |
| 702,958 | 7/1902 | Jones | 5/37 R |
| 709,333 | 9/1902 | Kragen | 5/44 R |
| 941,186 | 11/1909 | Brown | 5/37 C |
| 1,180,926 | 4/1916 | Jeffcott | 5/37 C |
| 1,354,540 | 10/1920 | Dixon | 5/37 C |
| 1,437,771 | 12/1922 | Mintz | 5/18 R |
| 1,741,192 | 12/1929 | Kusterer . | |
| 1,903,918 | 4/1933 | Fraser et al. . | |
| 2,343,642 | 3/1944 | Burton | 5/37 R |
| 2,491,911 | 12/1949 | Thompson . | |
| 2,723,401 | 11/1955 | Brede-Horst | 5/37 R |
| 4,007,961 | 2/1977 | Costa | 5/18 R |

FOREIGN PATENT DOCUMENTS

| | | | |
|---|---|---|---|
| 1101713 | 3/1961 | Fed. Rep. of Germany | 5/41 |

*Primary Examiner*—Ramon S. Britts
*Assistant Examiner*—Michael F. Trettel
*Attorney, Agent, or Firm*—Harpman & Harpman

[57] ABSTRACT

A folding chair that can be easily converted into a bed comprises a frame with three interconnected movable cushion assemblies positioned therein and removably attached to the frame and to a movable support member.

1 Claim, 5 Drawing Figures

FOLDING BED CHAIR WITH DETACHABLE CUSHIONS

This is a continuation in part of application Ser. No. 163,321 filed June 26, 1980.

BACKGROUND OF THE INVENTION

1. Field of the Invention

This invention relates to convertible chairs of the type using the seat and back cushions to form a horizontal bed.

2. Description of the Prior Art

Prior art devices have used a number of different ways to position cushions in horizontal alignment to form a bed. See for example U.S. Pat. Nos. 1,903,918; 2,491,911 and 1,741,192.

In U.S. Pat. No. 1,903,918, a chair or setee bed is disclosed wherein a single cushion is shaped to form the seat and back of the device.

In U.S. Pat. No. 2,491,911 a foldable chair is shown wherein the back cushions have legs and unfold to form a horizontal surface in line with a fixed seat cushion.

In U.S. Pat. No. 1,741,192 a convertible chair bed combination is shown wherein a rectangular base supports a pair of cushions and has a hinged extensible back that is arranged to support a third cushion.

Applicant's device uses a pair of spaced arms held in parallel relation by a horizontally disposed U-shaped frame. The U-shaped frame and the arms define a large open area in which a movable support member is positioned when the device is in a chair configuration.

Cushion assemblies hinged to one another with one cushion assembly removably engaged on the base of the U-shaped frame and arranged to be supported on the U-shaped frame and the movable support member in both chair and bed configurations complete the structure.

SUMMARY OF THE INVENTION

A folding chair bed is easily converted into a bed comprising spaced parallel arms with multiple cushion assemblies attached to one another and the chair. A movable seat support member that can be moved out from between the arms has one of the cushion assemblies attached thereto. A U-shaped support frame provides both parallel spacing for the arms and support for the cushion assemblies and defines the area in which the support member is positioned when the device is in the chair mode.

DESCRIPTION OF THE PREFERRED EMBODIMENT

Figure 4:
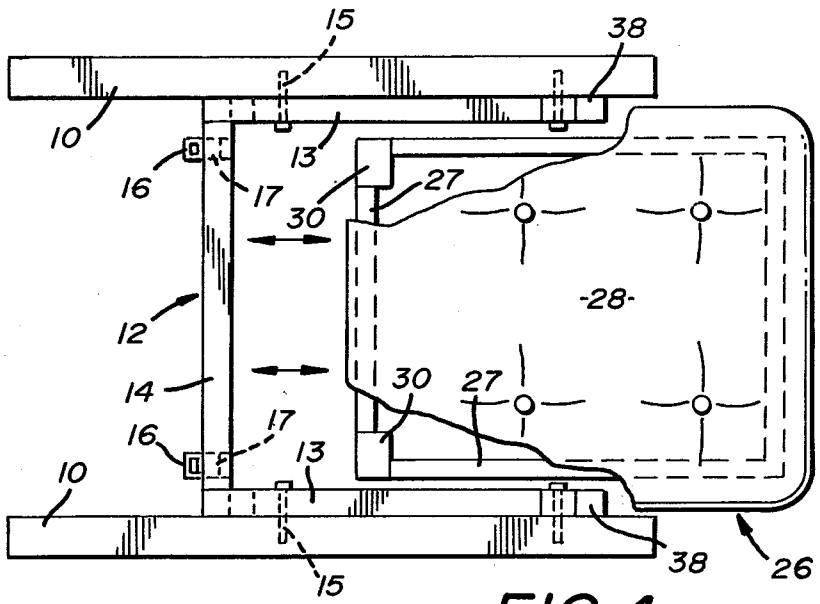
FIG. 4 is a top plan view with parts broken away.
Figure 3:
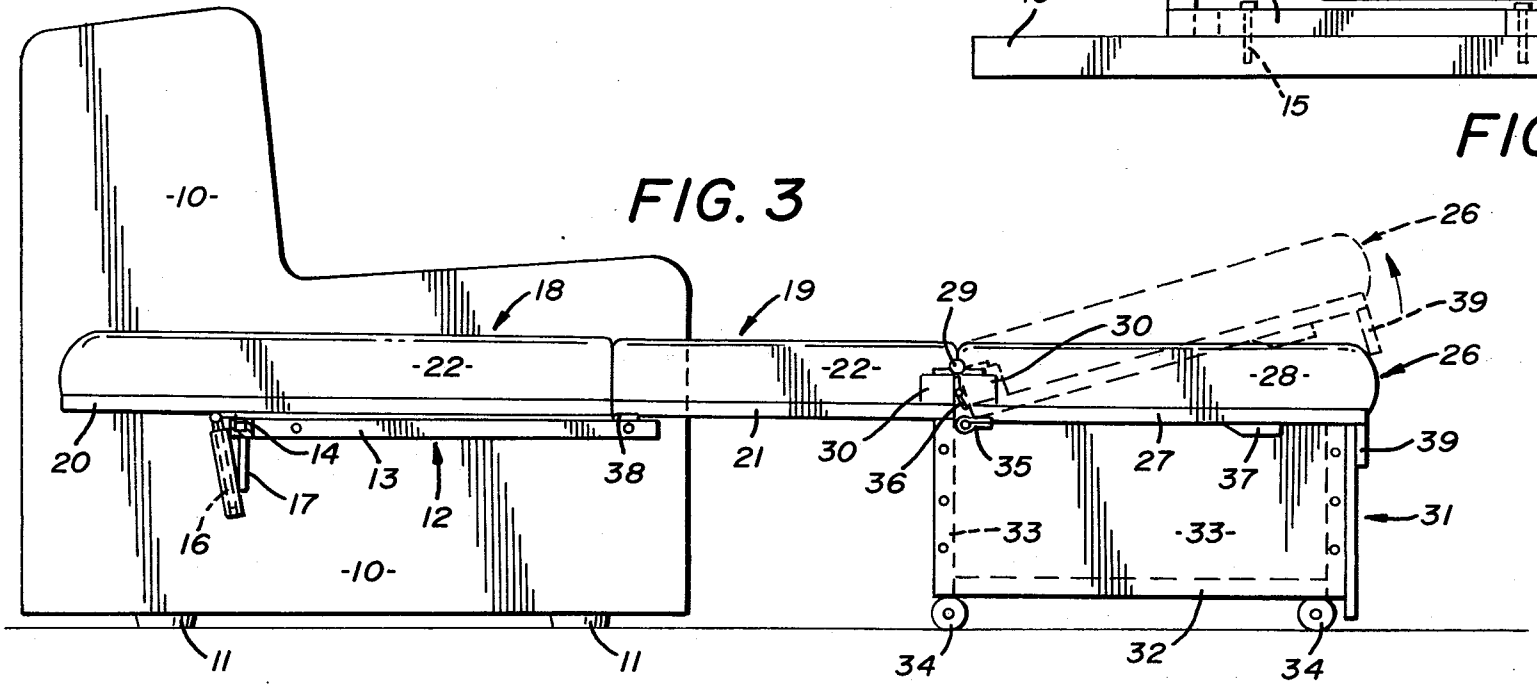
FIG. 3 is a side elevational view of the chair with one of the arms removed.
Figure 5:
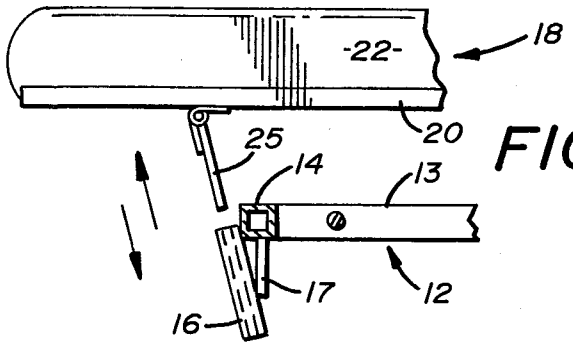
FIG. 5 is an enlarged detail of a portion of the bed-chair.

In the form of the invention chosen for illustration herein, the folding bed chair comprises a pair of spaced arms 10 as seen in FIG. 4 of the drawings, each having a pair of feet 11 as seen in FIG. 3 of the drawings.

Referring again to FIG. 4 of the drawings, a tubular U-shaped support frame 12 has a pair of horizontally extending tubular members 13 and a connecting tubular member 14 secured there between and forming the base of the U-shaped support frame 12. Each of the members 13 is secured to an arm 10 by a plurality of fasterners 15 which are positioned through apertures in the members 13.

As best seen in FIGS. 1,2,3 and 5 of the drawings, a pair of tubular socket members 16 are attached to and extend downwardly from the connecting tubular frame member 14 and are secured thereto as by welding. Support brackets 17 beneath the frame member 14 are also engaged on the socket members 16. The socket members 16 are disposed at an angle from vertical.

Figure 1:
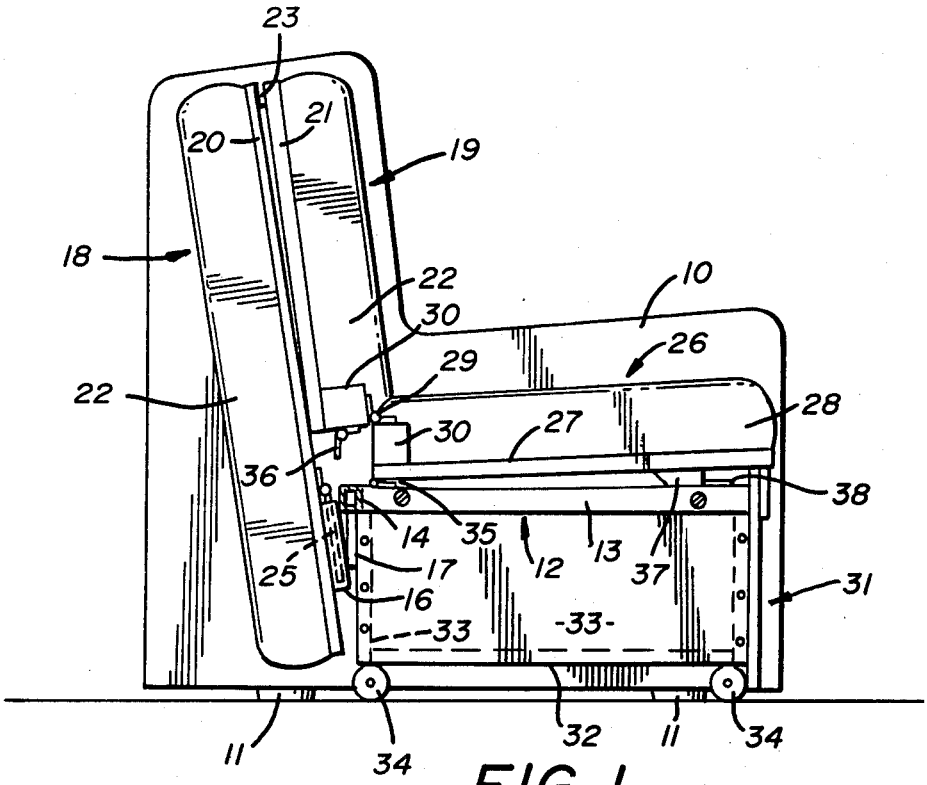
FIG. 1 is a side elevational view of the bed-chair with one of the arms removed.
Figure 2:
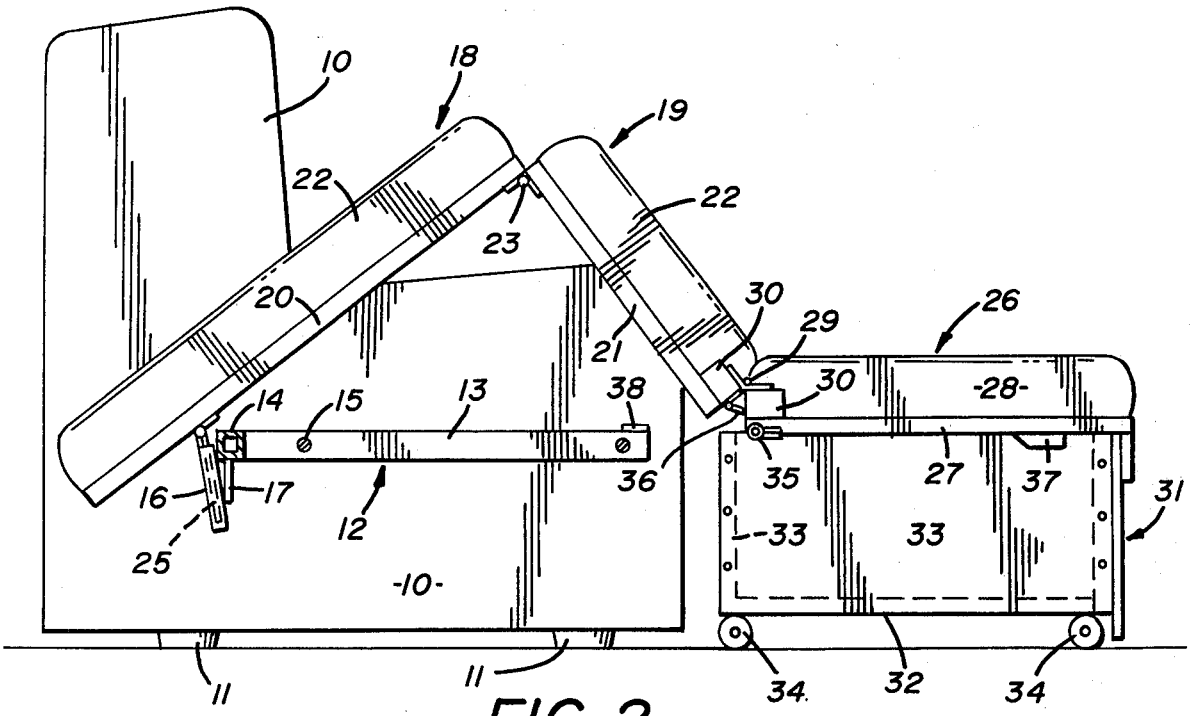
FIG. 2 is a vertical section of the bed-chair of FIG. 1.

By referring now to FIGS. 1 & 2 it will be seen that a pair of back cushion assemblies 18 and 19 are comprised of hardwood frames 20 and 21 having fabric covered foam cushions 22 secured thereto. The back cushion assemblies 18 and 19 are joined together at their adjacent ends by a continuous hinge 23 secured to the hardwood frames 20 and 21.

A pair of pins 25 are pivotally secured to the frame 20 of the cushion assembly 18 and adapted to engage the socket members 16 on the connecting frame member 14 of the U-shaped tubular frame 12 so that a detachable connection results.

A seat cushion assembly 26 has a hardwood frame 27 to which is secured a foam filled fabric covered cushion 28. The cushion assemblies 19 and 26 are pivotally secured to one another by a hinge 29 that is mounted on a pair of hinge support blocks 30 affixed to the frames 21 and 27 adjacent their respective ends. A movable support member 31 comprises a base 32 having four vertically extending side walls 33 and a number of casters 34 are secured to the base 32. The seat cushion assembly 26 is pivotally secured at one end to said movable support member 31 by a hinge 35. A short arm 36 is pivotally attached to one of the pair of hinge support blocks 30 and arranged to be moved there between to hold the same in spaced relation as seen in FIGS. 2 and 3 of the drawings. The short arm is used to reposition the cushion assemblies 18 and 19 as shown in FIG. 3.

Referring now to FIGS. 1,2 and 3 of the drawings, it will be seen that in order to open the folding chair to form a bed the user pulls the movable support member 31 outwardly from the area between the arms 10 which action will move the cushion assemblies 26, 18 and 19 forwardly. When the movable support member 31 is fully extended, the cushion assemblies 18 and 19 are horizontally positioned in end to end relation and supported on the U-shaped support frame 12 and the movable support member 31 thereby forming a cushioned horizontal sleeping surface with the cushion assembly 26 as seen in solid lines in FIG. 3 of the drawings.

In extended or open position one end of the seat cushion assembly 26 can be raised to provide access to the interior of the support member 31. Wedges 37 are positioned on the bottom of the hardwood frame 27 below the forward edge of the cushion assembly 26 so that this edge will be elevated when the movable support member 31 and the cushion assembly 26 are moved into the area between the arms 10 as seen in FIG. 1 of the drawings. Secondary blocks 38 are attached to the frame members 13 adjacent their forward ends so that the wedges 37 will engage the same when the cushion assembly 26 is in position thereon as seen in FIG. 1 of the drawings, thus holding the assembly in the chair mode.

To return the chair bed to its chair mode or configuration, the forward end of the cushion assembly 26 is lifted, as shown in broken lines in FIG. 3 of the drawings and the short arm 36 raised to space the blocks 30, whereupon moving the forward end of the cushion assembly downward will cause the cushion assemblies 18 & 19 to move upwardly as seen in FIG. 2, whereupon the support 31 and the cushion assemblies 18, 19 & 26 may be moved to the positions seen in FIG. 1 of the drawings.

In the chair mode as in FIG. 1 of the drawings the cushion assembly 18 rests against the socket members 16 preventing additional backward movement of the cushion assemblies 18 and 19 and thereby forming a sturdy and resilient back for the chair-bed.

A decorative panel 39 is attached to the forward edge of the hardwood frame 27 of the cushion assembly 26 so as to cover the opening created when the wedges 37 elevate the cushion assembly 26 as shown in FIG. 1 of the drawings.

It will thus be seen that a new and useful folding chair-bed has been illustrated and described and that various modifications may be made therein without departing from the spirit of the invention and having thus described my invention what I claim is:

1. An improvement in a folding bed chair having a pair of horizontally spaced vertically positioned arms and a movable support arranged for movement from a first position between said arms to a second position outwardly of said arms, three cushion assemblies and hinges securing said three cushion assemblies to one another in end to end relation, the improvement comprising means for holding said arms in spaced relation and partially supporting two of said three cushion assemblies when said cushion assemblies are in bed configuration and chair configuration, said means comprising a horizontally positioned U-shaped tubular member defining a pair of spaced parallel portions and a right angular joining base portion therebetween, said spaced parallel portions of said U-shaped tubular member being positioned alongside and attached to said spaced arms in oppositely disposed relation, fasteners incorporating hinges detachably engaged on said base portion of said U-shaped tubular member and on one of said two said cushion assemblies inwardly from the end thereof opposite the other one of said two cushion assemblies, said one of said two cushion assemblies and the third cushion assembly movably attached to said movable support and resting thereon, portions of said two cushion assemblies resting on said spaced parallel portions of said U-shaped tubular member when said movable support is in said second position outwardly of said arms and said two cushion assemblies resting on said base section of said U-shaped tubular member when said movable support is in said first position between said arms.

* * * * *